US011371669B2

(12) United States Patent
Kemetmüller et al.

(10) Patent No.: US 11,371,669 B2
(45) Date of Patent: Jun. 28, 2022

(54) LIGHTING DEVICE FOR A MOTOR VEHICLE HEADLIGHT AND MOTOR VEHICLE HEADLIGHT

(71) Applicant: ZKW Group GmbH, Wieselburg (AT)

(72) Inventors: Matthias Kemetmüller, Vienna (AT); Bernd Eichinger, Krummnussbaum (AT); Markus Danner, Ollersdorf (AT); Andreas Moser, Perg (AT); Lukas Leonhartsberger, Rosenau (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 17/415,826

(22) PCT Filed: Nov. 26, 2019

(86) PCT No.: PCT/EP2019/082583

§ 371 (c)(1),
(2) Date: Jun. 18, 2021

(87) PCT Pub. No.: WO2020/126350

PCT Pub. Date: Jun. 25, 2020

(65) Prior Publication Data

US 2022/0136670 A1 May 5, 2022

(30) Foreign Application Priority Data

Dec. 21, 2018 (EP) ..... 8215157

(51) Int. Cl.
*F21S 41/24* (2018.01)
*F21S 41/40* (2018.01)
(Continued)

(52) U.S. Cl.
CPC ..... *F21S 41/24* (2018.01); *F21S 41/148* (2018.01); *F21S 41/265* (2018.01);
(Continued)

(58) Field of Classification Search
CPC ..... F21S 41/24; F21S 41/265; F21S 41/322; F21S 41/148; F21S 41/40; F21S 43/245
See application file for complete search history.

(56) References Cited

U.S. PATENT DOCUMENTS 10,288,248 B1 * 5/2019 Crespin ..... F21S 41/141
2008/0239745 A1 10/2008 Naganawa et al.
(Continued)

FOREIGN PATENT DOCUMENTS

JP 2017084556 A 5/2017
WO 2017185118 A1 2/2017

OTHER PUBLICATIONS

International Search Report for PCT/EP2019/082583, dated Feb. 4, 2020 (12 pages).
(Continued)

*Primary Examiner* — Matthew J. Peerce
(74) *Attorney, Agent, or Firm* — Eversheds Sutherland (US) LLP

(57) ABSTRACT

The invention relates to a lighting device (1) for a motor vehicle headlight for generating a light pattern with a light-shadow line, wherein the lighting device comprises a light source (10), a light-permeable body (100), a light injection element (101) for injecting light which the at least one light source (10) emits, and a projection device (500). The light-permeable body (100) has an aperture device (103) with an aperture edge region (104). A light beam (S2) spreading in the optical element (110) is displayed by the projection device (500) as a light pattern (LV) with a light-shadow line (HD), with the light-shadow line (HD) being determined by the aperture edge region (104) of the aperture device (103). At least one light guide element (200, 300) is arranged on the optical element (110), which light guide element has a light guide element light incoupling face (201, 301) and a light guide element light outcoupling face (202, 302), the at least one light guide element (200, 300) being arranged on the optical element (110) in such a manner that light (S3) is injected from the light injection element (101) via the light guide element light incoupling face (201, 301) into the at least one light guide element (200, 300), spreads within this, and enters the optical element (110) again via the light guide element light outcoupling face (202, 302), the light guide element light outcoupling face (202, 302) of the at least one light guide element (200, 300) issuing into the optical element (110) in such a manner that the at least one light guide element light outcoupling face
(Continued)

Figure 1:
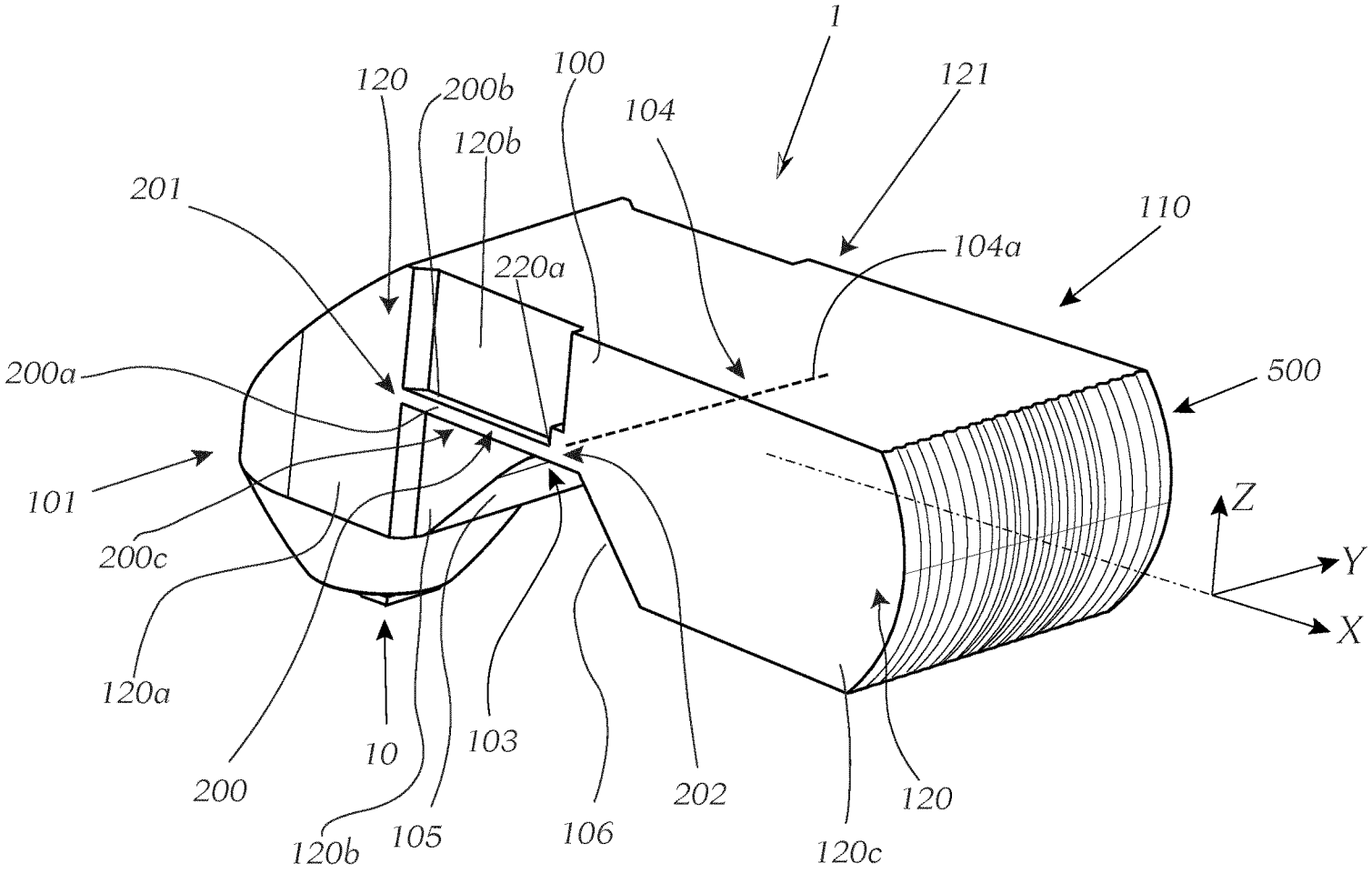

(200, 300) lies beneath the aperture edge region (104) as considered in the vertical direction (Z), so that the light rays (S5) re-entering the optical element (110) from the projection optical assembly (200) are projected as a sign-light light beam (SL) into a region (B) of the light pattern located above the light-shadow line, and are displayed in the light pattern as a sign-light light pattern (SV), for instance.

18 Claims, 5 Drawing Sheets

(51) Int. Cl.

| | |
|---|---|
| ***F21S 41/32*** | (2018.01) |
| ***F21S 41/265*** | (2018.01) |
| ***F21S 41/148*** | (2018.01) |
| ***F21W 102/135*** | (2018.01) |

(52) U.S. Cl.
CPC ..... *F21S 41/322* (2018.01); *F21S 41/40* (2018.01); *F21W 2102/135* (2018.01)

(56) References Cited

U.S. PATENT DOCUMENTS

| | | | | |
|---|---|---|---|---|
| 2014/0362596 | A1 | 12/2014 | Nakaya | |
| 2018/0058651 | A1 | 3/2018 | Gromfeld | |
| 2019/0017670 | A1 | 1/2019 | Zhu et al. | |
| 2022/0034467 | A1* | 2/2022 | Berrezai ..... | F21S 41/322 |

OTHER PUBLICATIONS

Search Report for European Patent Application No. 18215157.1 dated Jun. 19, 2019 (5 pages).

* cited by examiner

LIGHTING DEVICE FOR A MOTOR VEHICLE HEADLIGHT AND MOTOR VEHICLE HEADLIGHT

The invention relates to a lighting device for a motor vehicle headlamp for creating a light distribution with a cut-off line, wherein the lighting device has at least one light source, a translucent body, at least one light feed-in element for feeding in light which the at least one light source emits, and a projection device, wherein the translucent body, the at least one light feed-in element and the projection device form a one-piece transparent, translucent optical body, preferably made from the same material, wherein the translucent body has a diaphragm device with a diaphragm edge region, wherein the diaphragm device is arranged between the light feed-in element and the projection device in the light propagation direction, and wherein light of the at least one light source enters into the translucent body by means of the light feed-in element, which light propagates in the translucent body as a first light beam, and wherein the first light beam is modified by the diaphragm device to form a modified, second light beam in such a manner that this second light beam is imaged by the projection device as a light distribution with a cut-off line, wherein the cut-off line, particularly the shape and position of the cut-off line, is determined by a diaphragm edge region of the diaphragm device, and wherein the projection device is constructed to be inverting in the vertical direction.

Furthermore, the invention relates to a motor vehicle headlamp comprising at least one such lighting device.

An above-described lighting device for a motor vehicle headlamp or motor vehicle headlamps having one or more such lighting devices are known from the prior art and are used for example for realizing a dipped beam distribution or a part of a dipped beam distribution, particularly the near field light distribution of a dipped beam distribution.

In the following, relevant terms that are used should first be defined. The optical axis of the optical body or the projection optical device is labelled with X, this is approximately the main emission direction of the light from the optical body. A vertical axis, which stands orthogonally to the optical axis X, is defined with "Z". A further axis "Y", which stands orthogonally to the two other axes X, Z, runs transversely to the optical axis X.

The axes X, Z span a vertical plane, the axes X, Y span a horizontal plane.

If one is talking of the direction of light rays in the "vertical direction", the projection of these light rays into the X, Z plane is meant. If one is talking of the direction of light rays in the "horizontal direction", the projection of these light rays into the X, Y plane is meant.

Generally, the terms "horizontal" and "vertical" are used for a simplified representation of the circumstances; in a typical installation situation in a motor vehicle, the described axes and planes may actually lie horizontally and vertically. It may however also be provided that the lighting device or, in the case of a plurality of lighting devices, one or more, particularly all lighting devices, are rotated with respect to this position, for example the X axis may be inclined upwards or downwards with respect to a horizontal plane of the earth frame of reference, or the described X, Y, Z axial system may generally be rotated. It is therefore understood for a person skilled in the art that the terms used are used for a simplified description and do not necessarily have to be aligned in such a manner in the earth frame of reference.

The projection device has a focal point or a focal plane which lies approximately in the diaphragm edge region of the optical body. Accordingly, an intermediate light image in the region of the focal point or the focal plane, which intermediate image the optical body generates, is imaged by the projection device as a light distribution in front of the lighting device. In the case of a lighting device mentioned at the beginning, the projection device is constructed to be inverting in the vertical direction. This means that light rays which run in the focal plane above the horizontal X,Y plane come from the projection device to lie in the light image in a lower region, i.e. below what is known as the H-H line, whilst light rays which run in the focal plane in a region below the X,Y plane are imaged above the H-H line.

As a consequence of the design of the optical body with a diaphragm edge region which preferably protrudes from below the X,Y plane vertically as far as into this X,Y plane or slightly above the same, the light rays from the lower region, i.e. below the X,Y plane are blocked out, so that a dipped light distribution with a cut-off line, particularly a cut-off line running approximately horizontally in the light image, results, which dipped light distribution may for example also have an asymmetric portion.

According to legal regulations, light distributions of vehicle headlamps have to fulfil a series of requirements.

For example, according to ECE and SAE, minimum and maximum luminous intensities are required above the cut-off line (CO line)—that is to say outside of the primarily illuminated area—in certain regions. These function as what is known as a "sign light" and allow e.g. the illumination of overhead direction signs. The luminous intensities used in this case usually lie in the order of magnitude of conventional scattered light values, thus far below the luminous intensities below the cut-off line, but there are predetermined minimum luminous intensities to be exceeded. The required light values must be achieved with as little dazzling effect as possible.

It is an object of the invention to provide a lighting device for a motor vehicle headlamp, using which an above-described "sign light" can be created.

This object is achieved using a lighting device mentioned at the beginning in that according to the invention, at least one optical waveguide element is arranged on the optical body, which optical waveguide element has at least one optical waveguide element, one optical waveguide element light in-coupling surface and one optical waveguide element light out-coupling surface, and wherein the at least one optical waveguide element is arranged on the optical body in such a manner that light from the light feed-in element is fed via the optical waveguide element light in-coupling surface into the at least one optical waveguide element, propagates in the same, particularly at least partially by means of total internal reflection, and enters into the optical body again via the optical waveguide element light out-coupling surface, wherein the optical waveguide element light out-coupling surface of the at least one optical waveguide element opens into the optical body in such a manner that the at least one optical waveguide element light out-coupling surface lies at least partially, preferably completely below the diaphragm edge region as viewed in a vertical direction, wherein the at least one optical waveguide element or the optical waveguide elements preferably extends or extend in each case up to the diaphragm edge region or beyond, as viewed in the direction of an optical axis of the optical body, and wherein at least a portion, preferably all of the light rays that have entered into the optical body again is projected by the projection optical device as a sign light beam into a region of the light distribution lying above the cut-off line, and is imaged in the light image, for example as a sign light distribution.

Due to the diaphragm edge region, no light is available in a lighting device according to the prior art, which could be imaged as a sign light into a region above the H-H line. The invention makes it possible to conduct light from the light feed-in region below the diaphragm edge region of the projection device using the at least one optical waveguide element. As these light rays originate from a region of the focal plane of the projection device which lies substantially or completely below the X,Y plane, due to the position of the optical waveguide element light out-coupling surface of the at least one optical waveguide element, this light is imaged by the projection device into a region above the H-H line.

Preferably, it is provided that the optical body and the at least one optical waveguide element are constructed in one piece with one another and in particular from the same material. A design of this type has the advantage that no boundary surface, at which the light could inadvertently be diffracted out of the optical waveguide element, is created at the location where the optical waveguide element light out-coupling surface opens into the optical body. Light which "exits" from the "optical waveguide element light out-coupling surface" propagates easily in the optical body in the direction with which it emerges from the optical waveguide element.

Likewise, light from the light feed-in element enters into the optical waveguide element via the optical waveguide element light in-coupling surface without optical influencing, as no real boundary surface is present in the case of a one-piece design made from the same material.

Preferably, it is provided that the light-conducting optical body is laterally delimited by mutually opposite side boundary surfaces, wherein light propagating in the optical body is preferably at least partially reflected, particularly totally internally reflected, at the side boundary surfaces and wherein at least one optical waveguide element is arranged on at least one side boundary surface.

These side boundary surfaces may run parallel to one another and/or parallel to the optical axis of the optical body, preferably they diverge in the direction of the optical axis, so that the light beam propagating in the optical body can widen vertically.

In particular, it is provided that at least one optical waveguide element, preferably exactly one optical waveguide element in each case is arranged on each of the two side boundary surfaces. In this manner, the sign light distribution may also obtain a desired width in the horizontal direction.

It may be provided that the at least one optical waveguide element or the optical waveguide elements runs or run substantially parallel to an optical axis of the optical body. Light from the light feed-in region, which couples into the optical waveguide element essentially in the direction of the optical axis, in this case propagates in a straight line through the optical waveguide element without or only with one or few total internal reflection(s).

For example, it may be provided that the at least one optical waveguide element or the optical waveguide elements have a rectangular or square cross section or rectangular or square cross sections, wherein in the case of a plurality, all preferably have identical cross sections, and/or wherein the cross section of an optical waveguide element preferably remains the same over its entire longitudinal extent.

For a sign light distribution which is as symmetrical as possible as viewed in the horizontal direction in the light image, it is preferably provided that in the case of respectively one optical waveguide element per side boundary surface, the optical waveguide elements run at the same height as viewed in the vertical direction.

Preferably, it is provided that the at least one optical waveguide element or the optical waveguide elements has or have a straight course.

In particular, it may be provided that at least one, preferably all of the optical waveguide elements of a side boundary surface is/are arranged in such a manner that the optical waveguide element light out-coupling surface opens into the optical body below the diaphragm edge region or below a diaphragm edge lying in the diaphragm edge region.

It may also be provided that at least one of the optical waveguide elements of a side boundary surface is arranged in such a manner that an upper edge of the optical waveguide element light out-coupling surface opens into the optical body at the same height as the diaphragm edge region or a diaphragm edge lying in the diaphragm edge region.

For example, it may be provided that at least one of the side boundary surfaces, preferably both side boundary surfaces, are respectively divided into a rear boundary surface, a middle boundary surface and a front boundary surface, as viewed in the direction of the optical axis, wherein the middle boundary surface of the one or the two side boundary surface(s) in the horizontal direction is constructed to be set back, i.e. recessed, transversely to the optical axis with respect to the rear and front boundary surface of the respective side boundary surface, and wherein the at least one optical waveguide element is arranged on the middle side boundary surface, and is preferably integrally connected to the same, and extends from the rear region of the optical body, which is delimited by the rear side boundary surface, to the front region of the optical body, which is delimited by the front side boundary surface.

For example, the middle boundary surface runs approximately in the region of the light-conducting body, the rear boundary surface for example extends at least partially over a region of the light feed-in element, and the front region extends e.g. over the region of the projection device.

Preferably, boundary surfaces of the side boundary surface are constructed in a planar manner and for example parallel to one another.

An optical waveguide element therefore forms a type of web, which is located on the set-back boundary surface of the optical body, and is preferably constructed in one piece with the same.

Total internal reflection preferably occurs on outer surfaces, e.g. a top side and bottom side and a side outer surface of the optical waveguide element. Light can enter into the light-conducting body, as the optical waveguide element preferably adjoins the light-conducting body directly there and is preferably formed in one piece with the same from the same material, this light is captured by the diaphragm edge device.

Light moves through an optical waveguide element depending on the propagation direction, upon entry into the optical waveguide element straight through the same or it is totally internally reflected at boundary surfaces which outwardly delimit the optical waveguide element and propagates in such a manner to the projection device.

Preferably, it is provided that a lateral, preferably planar outer surface of the at least one optical waveguide element lies at the same height as the rear and/or front boundary surface of the side boundary surface on which it is arranged.

Furthermore, it may be provided that the diaphragm device is formed by boundary surfaces of the translucent body, which e.g. converge in a common diaphragm edge, which lies in the diaphragm edge region.

In this case, it may be provided that outside of the optical body, a physical diaphragm is placed between the boundary surfaces, and/or a coating or a physical diaphragm is placed on the outer side of at least one of the two boundary surfaces, preferably the boundary surface which is arranged in front of the other boundary surface in the light propagation direction, by means of which light exiting from the light-conducting body can be captured.

In this case, it is then advantageously provided that the physical diaphragm and/or the coating for each optical waveguide element has a recess, through which the optical waveguide element runs, so that light can propagate unhindered by the physical diaphragm and/or the coating.

Preferably it is provided that the light feed-in element comprises a light shaping optical element, which shapes the light emitted by the at least one light source in such a manner that the same is radiated substantially into the diaphragm edge region of the diaphragm device, and wherein the diaphragm edge region preferably lies substantially in a focal line or in a focal surface of the projection device.

The above formulation, which describes a bundling of the light rays onto a focal point or a focal plane of the projection device, which lies in or approximately in the diaphragm edge region, describes a simplified representation for a punctiform light source. In the case of the real, spatially extensive light sources (e.g. LED chip, approximately with 1 mm emission edge length) used, undesired light drops off, which impinges e.g. onto the boundary surface (and onto the previously discussed region, via which light exits) of the light-conducting body and is used according to the invention.

For example, the light shaping optical element is a collimator or the same comprises a collimator. It may additionally also be provided that the light feed-in element comprises deflecting means, e.g. as part of the light shaping optical element, e.g. one or more reflective surfaces, preferably one or more surfaces on which light is totally internally reflected, using which the light of the at least one light source is deflected in the desired direction.

The at least one light source can for example be arranged in the region of the optical axis of the optical body and have a main emission direction approximately in the direction of the optical axis. The at least one light source can however also be located above or below the optical axis and radiate light at an angle >0° to the optical axis, e.g. at 90° to the optical axis. In particular, in such an arrangement of the light sources, deflecting means are advantageous.

For example, the light shaping optical element is furthermore designed so as not only to collect light in the focal point, but rather in such a manner that light also aims vertically higher, above the diaphragm edge. Thus, a running out of the light distribution along the VV line from the HV point downwards to just in front of the vehicle can be achieved. In this manner, the light-conducting bodies according to the invention form a near field light distribution.

Preferably it is provided that the diaphragm edge region lies substantially in a focal line or in a focal surface of the projection device.

The focal line preferably lies below the diaphragm edge (or the diaphragm edge lies above the focal line) and runs horizontally through the focal point and transversely, particularly perpendicularly to the optical axis of the projection device.

It may be provided that the diaphragm edge region comprises at least one diaphragm edge extending substantially transversely to an optical axis of the projection device.

For example, the diaphragm edge is a single edge. However, a double edge may also be present, wherein the edges can then be arranged behind one another in the light exit direction.

The edge or the edges can be constructed to be as sharp as possible or for example rounded. Transversely to the optical axis X, the diaphragm edge region may, with reference to a horizontal plane, for example a horizontal plane which contains the optical axis X (X, Y plane), overall have the same normal distance from this horizontal plane. It may however also be provided that the diaphragm edge region has different (vertical) normal distances from the plane in different sections. For example, the diaphragm edge region may have a first normal distance from the plane in a first section and a second, larger normal distance in a second section. The different sections may be connected to one another by an obliquely running section. An asymmetric cut-off line may be created in this manner.

In light-conducting bodies of this type, an asymmetry in the cut-off line may also be achieved in that the different regions of the diaphragm edge in the horizontal direction, i.e. in the light propagation direction or in the direction of the optical axis, have different spacings from a vertical plane normal to the optical axis.

For example, it is provided that the projection device is constructed as a projection lens arrangement or comprises such, wherein the projection lens arrangement consists of a projection lens for example.

As described at the beginning, the projection device is constructed to be inverting in the vertical direction. Preferably, the projection device is further constructed in such a manner that, as viewed in the vertical direction, light rays which emanate from the same point in the intermediate light image but propagate in a different direction are imaged at the same height vertically in the light image by the projection device.

In the horizontal direction, such an influencing is preferably not provided, so that light which exits from the projection device is generally (depending on the propagation direction prior to exit) diffracted horizontally.

It may be provided that an outer surface of the projection device is formed by a groove-like structure in a smooth base surface, wherein the grooves forming the groove-like structure run in an essentially vertical direction, and wherein in each case two grooves lying next to one another in the horizontal direction are preferably separated by an elevation, which in particular runs substantially vertically and preferably extends over the entire vertical extent of the grooves. In this manner, the sign light region can be widened in the horizontal direction in a targeted fashion.

For example, in this case, the projection device is a projection lens in the form of a cylindrical lens, i.e. the boundary surface of the optical body has the shape of a curved surface of a cylinder, with the height of the cylinder running parallel to the Y axis. For example, the height of this cylinder lies in the X, Z plane.

That is to say, in sections in planes parallel to the X, Z plane, the projection lens has respectively identical lines of intersection (contours).

Preferably, it is provided that the light-conducting body and the projection device are constructed in one piece.

Advantageously, it is also provided that the light feed-in element is constructed in one piece with the light-conducting body. In particular, it is preferably provided that the light feed-in element(s), the light-conducting body and the projection device are constructed in one piece with one another, in particular are formed from a single, light-conducting material and form a single body ("optical body"). Furthermore, the optical waveguide element(s) according to the invention are constructed in one piece with the optical body described, particularly from the same transparent, light-conducting material.

Preferably, it is provided that the region into which the light coming from the optical waveguide(s) according to the invention is partially or completely projected extends in the light image in the vertical direction over a region of approx. 1°-6°, preferably over a region of 1.5°-4.5° above the 0°-0° (H-H) line, the horizon.

Furthermore, it may alternatively or additionally be provided that the region into which the entering light beam or parts thereof is or are projected extends in the light image in the horizontal direction over a region of approx. −24°-+24°, preferably approx. −18°-+18° or −10°-+10°.

For example, it is provided that the at least one light source comprises a light-emitting diode or a plurality of light-emitting diodes.

Figure 2:
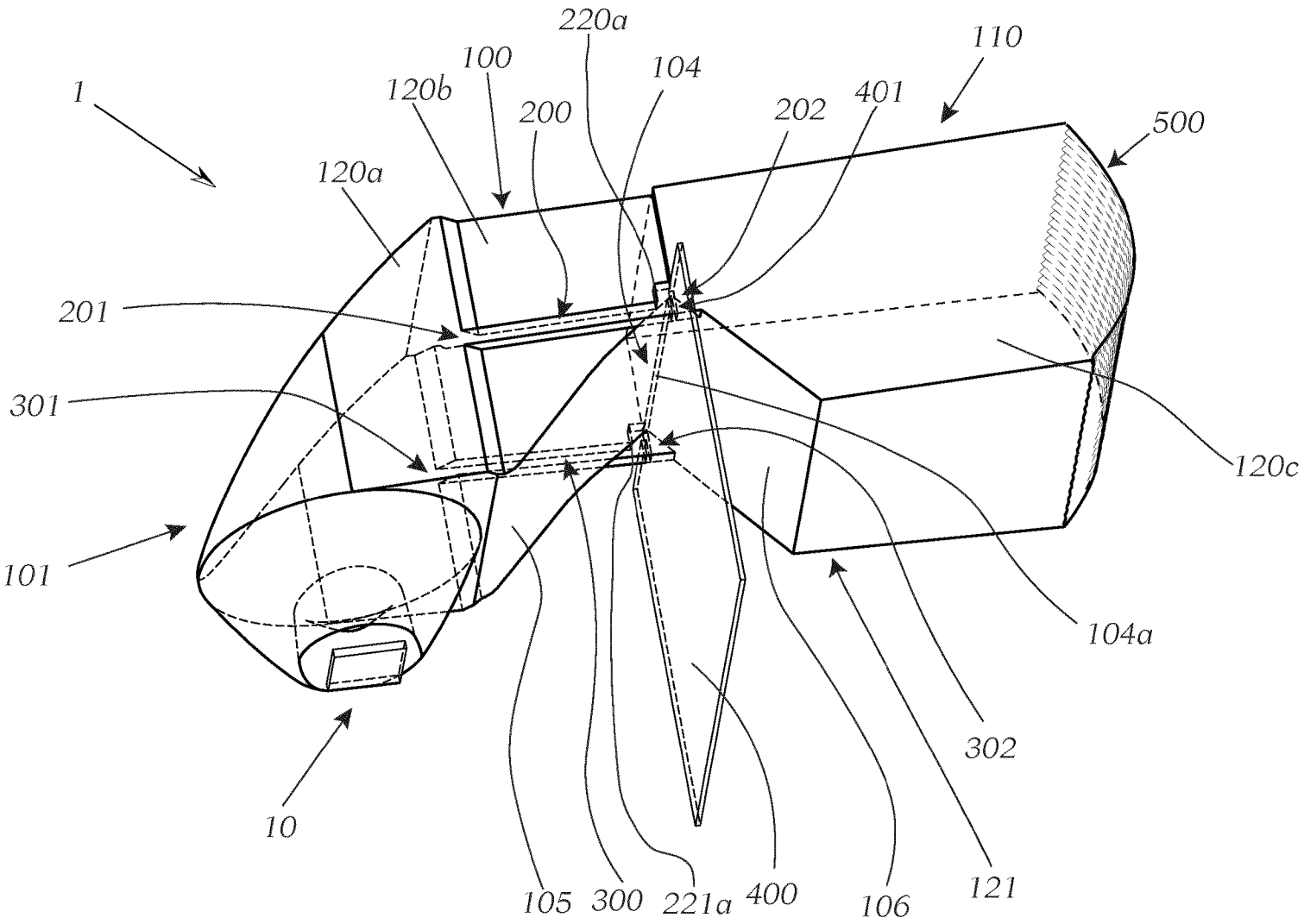
Figure 3:
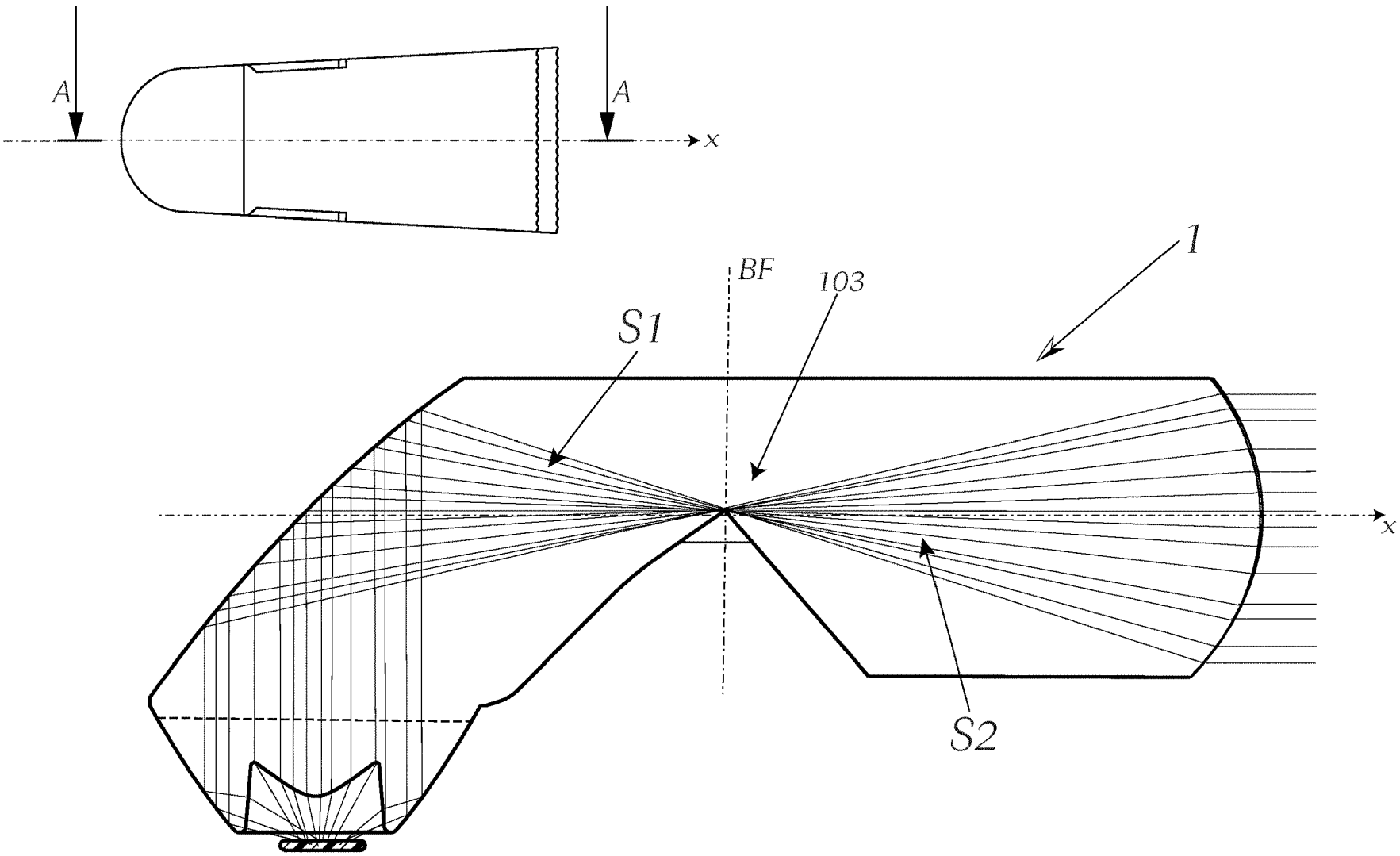
Figure 4:
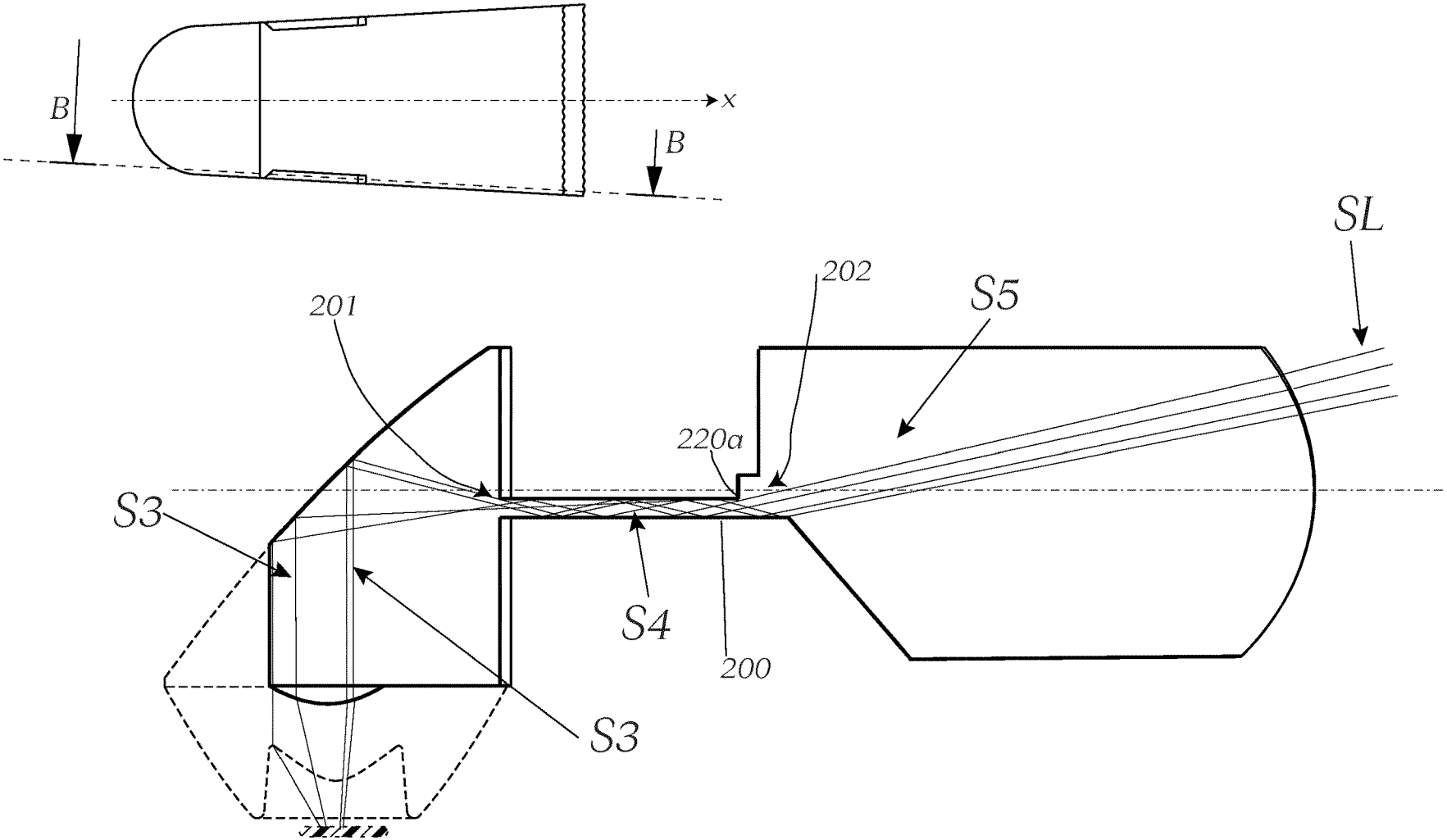
Figure 5:
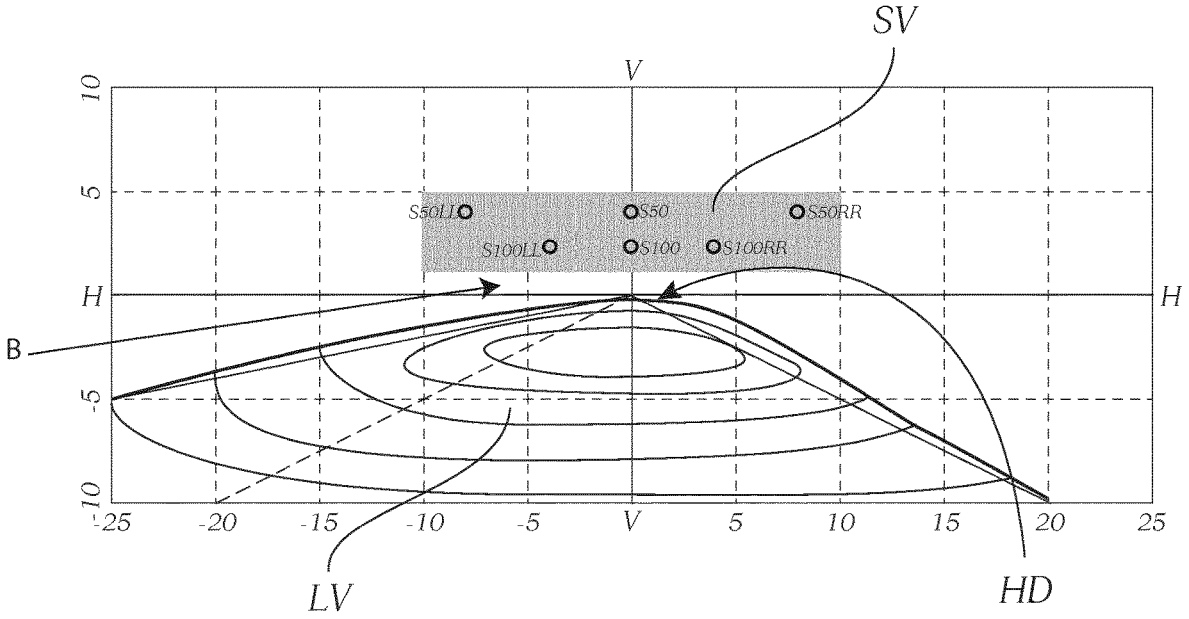

The invention is discussed in more detail in the following on the basis of the drawing. In the figures FIG. 1 shows the essential constituents of an embodiment according to the invention of a lighting device for a motor vehicle headlamp in a perspective view, FIG. 2 shows a further lighting device according to the present invention in a perspective view, FIG. 3 shows a vertical section A-A, which contains the optical axis, through the lighting device from FIG. 1, FIG. 4 shows a vertical section B-B parallel through a lighting device from FIG. 1 in a region of a side optical waveguide element, and FIG. 5 shows an exemplary schematic illustration of a light distribution generated using a lighting unit according to the invention.

FIG. 1 shows a lighting device 1 for a motor vehicle headlamp for generating a light distribution with cut-off line. The lighting device 1 comprises at least one light source 10, which comprises e.g. one or more LEDs, and an optical body 110, in which light of the at least one light source 10 can propagate.

In the example shown, the optical body 110 consists of a translucent body 100, which is constructed in one piece with a light feed-in element 101 for feeding in light, which the at least one light source 10 emits, and in one piece with a projection device 500.

Preferably, the optical body 110 is a solid body, i.e. a body which has no through openings or occluded openings. The transparent, translucent material from which the body 110 is formed has a refractive index greater than that of air. The material contains e.g. PMMA (polymethyl methacrylate) or PC (polycarbonate) and is in particular preferably formed therefrom. The body 110 may however also be manufactured from glass material, particularly inorganic glass material.

The optical body 110, actually the translucent body 100, has a diaphragm device 103 with a diaphragm edge region 104, wherein the diaphragm device 103 is arranged between the light feed-in element 101 and the projection device 500. The projection device 500 is in this case constructed to be inverting, as was already discussed at the beginning.

The diaphragm device 103 is e.g., as shown, formed by two boundary surfaces 105, 106 of the translucent body 100, which converge in the diaphragm edge region 104, particularly into a common diaphragm edge 104*a*.

In the following, for the principal functionality of the lighting device 1 shown, reference is made to FIG. 3, which shows a vertical section A-A through the lighting device 1 along the optical axis X (the location of the sectional plane A-A can be seen in the small image of FIG. 3, which shows a view of the optical body from above): Light of the at least one light source 10 is fed into the translucent body 100 via the light feed-in element 101, which light propagates in the translucent body 100 as first light beam S1. The light feed-in element 101, which is for example constructed as a collimator, is designed in such a manner that it bundles the light of the at least one light source mainly into the diaphragm edge region 104. The diaphragm edge region 104 lies in a focal point or in a focal surface BF of the projection device 500.

The first light beam S1 is modified by the diaphragm device 103 to form a modified, second light beam S2 in such a manner that this second light beam S2 is imaged by the projection device 500 as light distribution LV with a cut-off line HD (see FIG. 5, which shows an exemplary light distribution). The cut-off line HD, particularly the shape and position of the cut-off line HD, is determined by the diaphragm edge region 104, particularly the diaphragm edge 104*a* of the diaphragm device 103. The exemplary light distribution LV shown is a classic near field distribution.

The optical axis X is to be understood to mean the optical axis of the optical body 110, e.g. the centre line of the optical body 110 defined with respect to the apex of the exit lens or projection device.

FIG. 2 shows a lighting device 1, which is essentially identical to that from FIG. 1. The embodiment according to FIG. 2 only differs from that from FIG. 1 in that a diaphragm 400 is provided between the two surfaces 105, 106. Often, it cannot be avoided that light also impinges onto the boundary surface 105. This light may typically lead to undesired scattered light, which can be captured using this diaphragm 400. Alternatively, this diaphragm can also be placed on the outer side of the surface 105 as an absorbent layer.

According to the invention, it is provided that at least one optical waveguide element 200, 300, actually in the example shown, two optical waveguide elements 200, 300 (the second optical waveguide element 300 cannot be seen in the view from FIG. 1, but can be drawn from FIG. 2) are provided on the optical body 110. Each of the optical waveguide elements 200, 300 has an optical waveguide element light in-coupling surface 201, 301 and an optical waveguide element light-out coupling surface 202, 302. The optical waveguide elements 200, 300 are arranged on the optical body 110 in such a manner that light S3 from the light feed-in element 101 is fed into the optical waveguide elements 200, 300 via the optical waveguide element light in-coupling surface 201, 301, as is illustrated in the vertical sectional plane B-B according to FIG. 4 (the position of the sectional plane B-B can be seen in the small image of FIG. 4, which shows a view of the optical body from above) propagates in the same (light rays S4), particularly at least partially by means of total internal reflection, and enters into the optical body 110 again (light rays S5) via the optical waveguide element light out-coupling surfaces 202, 302.

In this case, the optical waveguide element light out-coupling surfaces 202, 302 open into the optical body 110 in such a manner that, as viewed in the vertical direction Z, the same lie at least partially, preferably completely below the diaphragm edge region 104, particularly below the diaphragm edge 104*a* and/or below the X,Y plane.

Preferably an upper edge 220*a*, 221*a* of the optical waveguide element light out-coupling surface 202, 302 lies at the same height as the diaphragm edge region 104 or the diaphragm edge 104*a* or preferably lies therebelow, as illustrated in the figures.

In addition, the optical waveguide elements 200, 300 in each case extend at least up to the diaphragm edge region 104 or the diaphragm edge 104*a* or beyond, as viewed in the direction of the optical axis X of the optical body 110.

The light rays S5 originating from the optical waveguide elements 200, 300 are ultimately projected by the projection device as a sign light beam SL into a region B of the light distribution lying above the cut-off line, and imaged for example in the light image as a sign light distribution SV.

Due to the diaphragm edge region 104 or the diaphragm device 103, no light, which could be imaged as a sign light into a region above the H-H line is available in a lighting device according to the prior art. The invention makes it possible to conduct light from the light feed-in region 101 below the diaphragm edge region, past the projection device 500 using the optical waveguide elements 200, 300. As these light rays S5 originate from a region of the focal plane of the projection device which lies substantially or completely below the X,Y plane, due to the position of the optical waveguide element light out-coupling surfaces 201, 301, this light S5 is imaged by the inverting projection device 500 into a region above the H-H line.

Preferably, optical body 110 and the optical waveguide elements 200, 300 are constructed in one piece with one another and in particular from the same material. A design of this type has the advantage that no boundary surface, at which the light could inadvertently be diffracted out of the optical waveguide element, is created at the location where the optical waveguide element light out-coupling surface opens into the optical body. Light which "exits" from the "optical waveguide element light out-coupling surface" propagates easily in the optical body in the direction with which it emerges from the optical waveguide element.

Likewise, light from the light feed-in element enters into the optical waveguide element via the optical waveguide element light in-coupling surface without optical influencing, as no real boundary surface is present in the case of a one-piece design made from the same material.

In this respect, the light in-coupling surfaces and the light out-coupling surfaces do not represent any real surfaces, particularly not any boundary surfaces, in which light is diffracted.

As can be seen in FIGS. 1 and 2, it may be provided that where the optical waveguide element 200 (the same is true for the second optical waveguide element 300, but this cannot be seen in the drawing) opens into the optical body 110 again in the region of the diaphragm edge 104*a*, the optical waveguide element 200 is widened upwards. This is connected with the fact that a hole could be created there in the case of an optical waveguide element 200 which continues to run straight and due to the converging surfaces 105, 106, which hole could be disadvantageous from a manufacturing engineering viewpoint. Accordingly, a widening of the optical element(s) 200 may be provided there, which has no influence optically however.

The optical body 110 is laterally delimited by mutually opposite side boundary surfaces 120, 121. Light propagating in the optical body 110 can be at least partially, preferably completely reflected, particularly totally internally reflected, at the side boundary surfaces 120, 121. In the example shown, these side boundary surfaces 120, 121 are planar and diverge in the direction of the optical axis X of the optical body 110 (see small image in FIG. 3 and FIG. 4).

The optical waveguide elements 200, 300 are arranged on the side boundary surfaces 120, 121. Preferably, the optical waveguide elements 200, 300 are configured identically and run at the same height on the optical body 110, in particular, these preferably run parallel to the optical axis X.

For example, the optical waveguide elements, as observed in sections normal to the optical axis X, have rectangular or square cross sections.

In the actual embodiment according to FIG. 1, it is provided that both side boundary surfaces 120, 121 are respectively divided into a rear boundary surface 120*a*, a middle boundary surface 120*b* and a front boundary surface 120*c*, as viewed in the direction of the optical axis X, wherein the middle boundary surface 120*b* of each of the two side boundary surfaces 120, 121 in the horizontal direction Y is constructed to be set back, i.e. recessed, transversely to the optical axis X with respect to the rear and front boundary surface 120*a*, 120*c* of the respective side boundary surface 120, 121.

One optical waveguide element 200, 300 in each case is arranged on this recessed, middle side boundary surface 120*b* and preferably integrally connected to the same. The optical waveguide element 200, 300 extends in the direction of the optical axis X from the rear region of the optical body 110, which is delimited by the rear side boundary surface 120*a*, up to the front region of the optical body 110, which is delimited by the front side boundary surface 120*c*.

For example, the middle boundary surface 120*b* runs approximately in the region of the light-conducting body 100, the rear boundary surface 120*a* for example extends at least partially over a region of the light feed-in element 101, and the front region 120*c* extends e.g. at least partially over the region of the projection device 500.

An optical waveguide element 200, 300 therefore forms a type of web, which is located on the set-back boundary surface 120*b* of the optical body 110, and is preferably constructed in one piece with the same.

As shown, a lateral, preferably planar outer surface 200*a* of each optical waveguide element 200, 300 lies at the same height as the rear and front boundary surface 120*a*, 120*c* of the side boundary surface 120, 121 on which it is arranged.

Total internal reflection preferably occurs at the lateral outer surface 200*a*, a top surface 200*b* and a bottom surface 200*c* of each optical waveguide element 200, 300. Light can enter into the light-conducting body, as the optical waveguide elements 200, 300 preferably adjoin the light-conducting body 100 or optical body 110 directly there and are particularly formed in one piece with the same from the same material, this light is captured by the diaphragm edge device 103 in the optical body.

Light moves through an optical waveguide element depending on the propagation direction, upon entry into the optical waveguide element straight through the same or it is totally internally reflected at boundary surfaces 200*a*, 200*b*, 200*c* which outwardly delimit the optical waveguide element and propagates in such a manner to the projection device 500.

As described at the beginning, the projection device 500 is constructed to be inverting in the vertical direction. Preferably, the projection device 500 is further constructed in such a manner that, as viewed in the vertical direction, light rays which emanate from the same point in the intermediate light image (i.e. an image in the focal plane of the projection device 200 (which is preferably vertical, normal to the optical axis X), in which the diaphragm edge 104*a* preferably approximately lies) but propagate in a different direction are imaged at the same height vertically in the light image by the projection device.

In the horizontal direction, such an influencing is preferably not provided, so that light which exits from the projection device 500 is generally (depending on the propagation direction prior to exit) diffracted horizontally.

Considered generally, the projection device 500 is e.g. constructed as a projection lens arrangement or comprises such. Actually, in the example shown, the projection device 500 comprises a boundary surface (or it consists of such a boundary surface), which delimits the optical body 110 to the front, and by means of which boundary surface the light propagating in the optical body, particularly the light rays S5, are imaged as a light distribution into a region in front of the optical body 110. In order to achieve a corresponding diffraction due to light refraction of the light rays when exiting via the light exit surface, as described, the light exit surface is correspondingly shaped, particularly curved. Preferably, the boundary surface is designed to be convex in this case. In the example shown, the boundary surface is curved convexly in vertical sections in this case, whilst it runs straight in horizontal sections parallel to the optical axis.

Furthermore, it may also be provided that an outer surface of the projection device 500 is formed by a groove-like structure in the smooth base surface, as is indicated in FIG. 1, wherein the grooves forming the groove-like structure run in an essentially vertical direction, and wherein in each case two grooves lying next to one another in the horizontal direction are preferably separated by an elevation, which in particular runs substantially vertically and preferably extends over the entire vertical extent of the grooves. In this manner, the sign light region can be widened in the horizontal direction in a targeted fashion.

For example, in this case, the projection device 500 is a projection lens in the form of a cylindrical lens, i.e. the boundary surface of the optical body, which is acting as projection lens, has the shape of part of a curved surface of a cylinder, with the height of the cylinder running parallel to the Y axis. For example, the height of this cylinder lies in the X, Z plane.

That is to say, in sections in planes parallel to the X, Z plane, the projection lens has respectively identical lines of intersection (contours).

The design according to FIG. 2 only differs from that from FIG. 1 due to the diaphragm 400, wherein the diaphragm 400 for the invention is modified in that it has a recess 401 for each optical waveguide element 200, 300, through which the optical waveguide element 200, 300 is guided.

The sign light beam SL (FIG. 4) is projected into a region B of the light distribution lying above the cut-off line, and imaged for example in the light image (FIG. 5) as a sign light distribution SV.

The region B into which the entering light beam S4 or parts thereof is or are projected extends in the light image in the vertical direction over a region of approx. 1°-6°, preferably, as shown, over a region of 1.5°-4.5° above the H-H line.

In the horizontal direction, the region B typically extends over a region of approx. −10°-+10°, preferably over −8°-+8°.

The invention claimed is:

1. A lighting device (1) for a motor vehicle headlamp for creating a light distribution with cut-off line, the lighting device comprising:

at least one light source (10) which is configured to emit light;

a translucent body (100);

at least one light feed-in element (101) for feeding in the light; and a projection device (500), wherein the translucent body (100), the at least one light feed-in element (101) and the projection device (500) form a one-piece optical body (110), from the same material, wherein the translucent body (100), has a diaphragm device (103) with a diaphragm edge region (104), the diaphragm device (103) being arranged between the light feed-in element (101) and the projection device (500) in the light propagation direction, and wherein the light of the at least one light source (10) entering into the translucent body (100) by the light feed-in element (101), which light propagates in the translucent body (100) as a first light beam (S1), and the first light beam (S1) being modified by the diaphragm device (103) to form a modified, second light beam (S2) in such a manner that this second light beam (S2) is imaged by the projection device (500) as a light distribution (LV) with a cut-off line (HD), the shape and position of the cut-off line (HD) being determined by the diaphragm edge region (104) of the diaphragm device (103), wherein the projection device (500) is constructed to be inverting in the vertical direction, wherein at least one optical waveguide element (200, 300) is arranged on the optical body (110), which optical waveguide element has at least one optical waveguide element (200, 300), an optical waveguide element light in-coupling surface (201, 301) and one optical waveguide element light out-coupling surface (202, 302), and wherein the at least one optical waveguide element (200, 300) is arranged on the optical body (110) in such a manner that light (S3) from the light feed-in element (101) is fed via the optical waveguide element light in-coupling surface (201, 301) into the at least one optical waveguide element (200, 300), propagates in the same direction, at least partially by means of total internal reflection, and enters into the optical body (110) via the optical waveguide element light out-coupling surface (202, 302), wherein the optical waveguide element light out-coupling surface (202, 302) of the at least one optical waveguide element (200, 300) opens into the optical body (110) in such a manner that the at least one optical waveguide element light out-coupling surface (200, 300) lies at least partially below the diaphragm edge region (104) as viewed in a vertical direction (Z), wherein the at least one optical waveguide element (200, 300) or the optical waveguide elements (200, 300) extends or extend in each case up to the diaphragm edge region (104) or beyond, as viewed in the direction of an optical axis (X) of the optical body (110), and wherein at least a portion of the light rays (S5) that have entered into the optical body (110) are projected by the projection optical device (200) as a sign light beam (SL) into a region (B) of the light distribution lying above the cut-off line, and are imaged in the light image, for example as a sign light distribution (SV).

2. The lighting device according to claim 1, wherein the optical body (110) and the at least one optical waveguide element (200, 300) are constructed in one piece with one another and from the same material.

3. The lighting device according to claim 1, wherein the optical body (110) is laterally delimited by mutually opposite side boundary surfaces (120, 121), wherein light propagating in the optical body (110) is at least partially reflected, particularly totally internally reflected, at the side boundary surfaces (120, 121) and wherein at least one optical waveguide element (200, 300) is arranged on at least one side boundary surface (120, 121), wherein at least one optical waveguide element (200, 300) is arranged on each of the two side boundary surfaces (120, 121).

4. The lighting device according to claim 1, wherein the at least one optical waveguide element (200, 300) or the optical waveguide elements (200, 300) runs or run substantially parallel to an optical axis (X) of the optical body (110).

5. The lighting device according to claim 1, wherein the at least one optical waveguide element (200, 300) or the optical waveguide elements (200, 300) have a rectangular or square cross section or rectangular or square cross sections, wherein in the case of a plurality of optical waveguide elements (200, 300), all have identical cross sections, and/or wherein the cross section of an optical waveguide element (200, 300) remains the same over its entire longitudinal extent.

6. The lighting device according to claim 3, wherein in the case of one optical waveguide element (200, 300) per side boundary surface (120, 121) in each case, the waveguide optical elements (200, 300) run at the same height, as viewed in the vertical direction.

7. The lighting device according to claim 1, wherein the at least one optical waveguide element (200, 300) or the optical waveguide elements (200, 300) has or have a straight course.

8. The lighting device according to claim 1, wherein (i) at least one of the optical waveguide elements (200, 300) of a side boundary surface (120, 121) is arranged in such a manner that the optical waveguide element light out-coupling surface (202, 302) opens into the optical body (110) below the diaphragm edge region (104) or below a diaphragm edge (104*a*) lying in the diaphragm edge region (104), or (ii) at least one of the optical waveguide elements (200, 300) of a side boundary surface (120, 121) is arranged in such a manner that an upper edge (220*a*, 221*a*) of the optical waveguide element light out-coupling surface (202, 302) opens into the optical body (110) at the same height as the diaphragm edge region (104) or a diaphragm edge (104*a*) lying in the diaphragm edge region (104).

9. The lighting device according to claim 3, wherein at least one of the side boundary surfaces (120, 121) is respectively divided into a rear boundary surface (120*a*), a middle boundary surface (120*b*) and a front boundary surface (120*c*), as viewed in the direction of the optical axis (X), wherein the middle boundary surface (120*b*) of the one or the two side boundary surface(s) (120, 121) in the horizontal direction (Y) is constructed to be recessed, transversely to the optical axis (X) with respect to the rear and front boundary surface (120*a*, 120*c*) of the respective side boundary surface (120, 121), and wherein the at least one optical waveguide element (200, 300) is arranged on the middle side boundary surface (120*b*), and is integrally connected to the same, and extends from the rear region of the optical body, which is delimited by the rear side boundary surface (120*a*), to the front region of the optical body, which is delimited by the front side boundary surface (120*c*).

10. The lighting device according to claim 9, wherein a lateral, planar outer surface (200*a*) of the at least one optical waveguide element (200, 300) lies at the same height as the rear and/or front boundary surface (120*a*, 120*c*) of the side boundary surface (120, 121) on which it is arranged.

11. The lighting device according to claim 1, wherein the diaphragm device (103) is formed by boundary surfaces (105, 106) of the translucent body (100), which converge in a common diaphragm edge (104*a*), which lies in the diaphragm edge region (104), wherein, outside of the optical body (100), a physical diaphragm (300) is placed between the boundary surfaces (105, 106), and/or a coating or a physical diaphragm is placed on the outer side of at least one of the two boundary surfaces (105, 106), by means of which light exiting from the light-conducting body (100) can be captured.

12. The lighting device according to claim 11, wherein the physical diaphragm (400) and/or the coating for each optical waveguide element (200, 300) has a recess (401), through which the optical waveguide element (200, 300) runs, so that light can propagate unhindered by the physical diaphragm (400) and/or the coating.

13. The lighting device according to claim 1, wherein the light feed-in element (101) comprises a light shaping optical element, which shapes the light (S1) emitted by the at least one light source (10) in such a manner that the same is radiated substantially into the diaphragm edge region (104) of the diaphragm device (103), and wherein the diaphragm edge region (104) lies substantially in a focal line or in a focal surface (FB) of the projection device (500).

14. The lighting device according to claim 1, wherein an outer surface of the projection device (500) is formed by a groove-like structure in a smooth base surface, wherein the grooves forming the groove-like structure run in an essentially vertical direction, and wherein in each case two grooves lying next to one another in the horizontal direction are separated by an elevation, which in particular runs substantially vertically and extends over the entire vertical extent of the grooves.

15. A motor vehicle headlamp comprising at least one lighting device according to claim 1.

16. The lighting device according to claim 3, wherein exactly one optical waveguide element (200, 300) is arranged on each of the two side boundary surfaces (120, 121).

17. The lighting device according to claim 9, wherein both side boundary surfaces are divided into a rear boundary surface (120*a*), a middle boundary surface (120*b*), and a front boundary surface (120*c*).

18. The lighting device according to claim 11, wherein the coating or physical diaphragm is placed on the outer side of the boundary surface (105) which is arranged in front of the other boundary surface (106) in the light propagation direction.

* * * * *